US006711878B1

(12) United States Patent
Paselsky et al.

(10) Patent No.: US 6,711,878 B1
(45) Date of Patent: Mar. 30, 2004

(54) CARTONER WITH INTERMEDIATE TRANSFER

(75) Inventors: John M. Paselsky, Hebron, KY (US); Matthew R. Lukes, Independence, KY (US)

(73) Assignee: R. A. Jones & Co. Inc., Covington, KY (US)

( * ) Notice: Subject to any disclaimer, the term of this patent is extended or adjusted under 35 U.S.C. 154(b) by 9 days.

(21) Appl. No.: 10/177,363

(22) Filed: Jun. 21, 2002

Related U.S. Application Data

(63) Continuation of application No. 09/584,335, filed on May 31, 2000, now abandoned.
(60) Provisional application No. 60/136,888, filed on Jun. 1, 1999.

(51) Int. Cl.[7] ..... B65B 5/00
(52) U.S. Cl. ..... 53/252; 53/251; 53/255; 53/237; 53/534; 53/543
(58) Field of Search ..... 53/154, 240, 244, 53/247, 251, 252, 255, 257, 237, 534, 543, 547, 548, 549, 566

(56) References Cited

U.S. PATENT DOCUMENTS 3,300,947 A * 1/1967 Fahrenbach ..... 53/566
3,778,959 A * 12/1973 Langen et al. ..... 53/251
4,191,003 A * 3/1980 Talarico ..... 53/247
5,241,806 A 9/1993 Ziegler et al.
5,454,211 A * 10/1995 Ziegler et al. ..... 53/252
5,456,058 A 10/1995 Ziegler
5,477,655 A * 12/1995 Hawley ..... 53/251
5,502,950 A * 4/1996 Moncrief et al. ..... 53/251
5,546,734 A * 8/1996 Moncrief et al. ..... 53/251
5,666,789 A 9/1997 Ziegler
5,692,361 A 12/1997 Ziegler et al.
5,727,365 A * 3/1998 Lashyro et al. ..... 53/252
5,852,912 A * 12/1998 Chalendar ..... 53/251

* cited by examiner

*Primary Examiner*—John Sipos
*Assistant Examiner*—Louis Huynh
(74) *Attorney, Agent, or Firm*—Wood, Herron & Evans LLP

(57) ABSTRACT

A cartoner has an intermediate transfer disposed between each article infeed area and an adjacent bucket conveyor to transfer separate rows of select article count into buckets on the adjacent bucket conveyor. The intermediate transfer runs only the length necessary to feed rows into a bucket for one tier or group of articles. Row selecting and forming devices on, or extending from, buckets or bucket walls are eliminated. A sheet feeder feeds partitions over the upstream end of a group receiving bucket conveyor for deposit on a lower group of articles on which an upper group is to be formed.

13 Claims, 4 Drawing Sheets

CARTONER WITH INTERMEDIATE TRANSFER

This application is a continuation of U.S. Ser. No. 09/584,335, filed May 31, 2000 now abandoned, which is expressly incorporated herein by reference. This application discloses and claims only subject matter disclosed in said prior application Ser. No. 09/584,335, filed May 31, 2000 and names inventors named in said prior application.

Applicant claims the benefit of the filing date of applicant's prior filed provisional application, Ser. No. 60/136,888 filed Jun. 1, 1999 entitled "CARTONER WITH INTERMEDIATE TRANSFER", which is expressly incorporated herein by reference.

BACKGROUND OF THE INVENTION

This invention relates to cartoners and more particularly to cartoners for loading groups of articles in single tier or stacked tier format into cartons.

Apparatus and methods for grouping articles and inserting them into cartons in one or more layers or tiers are well known. For example, articles are fed in feed lanes at an angle toward a bucket conveyor. A device segregates a select number of articles in each lane to form a row of articles to be combined with other, like-formed rows from other lanes into a group. This group is transported downstream in a bucket and then inserted transversely from the bucket into an adjacent carton also moving downstream. Generally, bucket conveyors transport the formed groups in buckets in parallel with an adjacent carton conveyor, and the groups are sequentially transferred from the bucket conveyor, sometimes across an intermediate transfer conveyor, into the cartons. This is typically accomplished in the prior art by a barrel loader, for example, or by direct loading. Examples of such systems can be seen in U.S. Pat. Nos. 3,778,959 and 5,241,806.

When it is desirable to load a carton with two tiers or two stacked groups, one atop another, it is known that two of the single level devices, such as in U.S. Pat. Nos. 3,778,959 or 5,241,806 can be combined. Typically, a partition or slip sheet is inserted over the first lower group at a location between the formation of such a lower group and the formation of a second upper group. The upper group is then formed on top of the partition and the two, stacked groups and intermediate partition are loaded into a carton, tall enough to accept both groups, in a fashion similar to single level or single group loading. Such two-tier or dual-layer systems are shown in prior art patents such as U.S. Pat. Nos. 5,666,789 and 5,692,361. Such systems use the same flight bars for forming and transporting rows of articles and groups thereof in both upper and lower levels of groups. That is, the same flight bars extend through and are operational in both upper and lower group forming stations.

These systems have at least two inherent design limitations of major operational significance.

First, there is a matter of changeover costs where different articles are to be handled. In such systems, the devices metering the articles and forming the rows are flight bars attached to and extending from the structure of the bucket conveyors. Wedges are formed on the end of the flight bars to handle articles of particular diameter or varying article counts. The width of the bars and/or spacing therebetween must be changed when articles of different diameter or different counts of articles are to be cartoned. This requires a changeover of the flight bars or "wedges" associated with each bucket of the bucket conveyor. Thus, the cost of changeover is, in part, a function of the number of buckets in the system and the down-time required to modify each one.

Accordingly, it has been one objective of the invention to reduce the number and cost of changeover parts, and the downtime necessary for any changeover in article size.

In another aspect of the inherent design of prior systems, and particularly in multiple layer systems, a partition or slip sheet is inserted by a sheet feeder into the moving line of grouped articles between the lower group forming apparatus located upstream, and the upper group forming apparatus located downstream. In that position, the sheet feeder and its attendant magazine are surrounded by the lower group forming apparatus, the adjacent infeed for the upper group, the upper group forming apparatus, and the bucket conveyor as well as perhaps the carton conveyor. This severely limits access to the sheet feeder and its associated magazine for resupply, maintenance and repair. Either access to the prior devices is limited, or the entire cartoner footprint must be unduly and expensively lengthened to provide an accessible area station for the feeder between major elements of lower and upper group forming operations.

Accordingly, it has been a further objective of this invention to provide an improved cartoner for multi-level groups of articles with a sheet feeder having improved access without requiring undue length extension of the cartoner's footprint.

BRIEF SUMMARY OF THE INVENTION

To these ends, the invention contemplates, in a preferred embodiment, a cartoner having an intermediate transfer conveyor separate and independent of an adjacent, longer bucket conveyor and extending alongside the bucket conveyor for so much length as required to select, receive and transfer select count rows of articles from respective article infeed lanes to the buckets of the bucket conveyor. The phrase "separate and independent" means not attached to or part of the buckets of the bucket conveyor, but constituting a distinct conveyor. Article selecting or row defining wedges or transfer guides are carried on the intermediate transfer conveyor. These transfer guides extend into article feed lanes, intersect articles, select a count of articles in each lane to form a group row and transfer the row into the buckets. While the guides are indexed with the buckets, they are separate and independent, i.e. distinct therefrom. The guides are thus operational to define select count rows, but at the same time, only a relative few guides are required when compared to the number of buckets desired or used, since the transfer conveyor extends through only a short run adjacent the much longer bucket conveyor.

This is due to the fact that the intermediate transfer conveyor need only be so long as to present a transfer guide to select rows, and then move the rows along until transferred to a bucket. Thereafter, the guide can be returned for subsequent row selections and transfers. There are, in this invention, no article selecting or group or row forming devices or flight bars carried on the buckets themselves.

Accordingly, when it is desired to changeover the apparatus to handle articles of differing diameter or count, it is only necessary to change the few transfer guides and not a device on every bucket of the bucket conveyor. Since the transfer conveyor carrying the transfer guides is very short, it will be appreciated that each guide will select respective rows of articles for more than one bucket on the bucket conveyor for the layer in question. Thus, the number of changeover parts, costs and downtime is significantly reduced, as are the number of product engaging parts in the system.

And where a multiple layer or dual layer system is contemplated, it is appreciated that a further separate and independent second transfer conveyor, totally distinct, spaced and elevated from the bucket conveyor different than the first transfer conveyor for the other level, is used. Thus, each level of articles is acted on by a separate and distinct intermediate transfer conveyor. The intermediate transfer conveyor and transfer guides for one group level have no function with any articles of the other group level for the same carton. There are instead two separate intermediate conveyors and with separate sets of guides. While each guide may be changed when articles of different diameters or count are to be cartoned, the total number of changeover parts and downtime is still significantly less than if wedges or bars on each bucket of the longer bucket conveyor had to be changed.

Moreover, where dual tier cartoning is provided according to the invention, the use of two separate intermediate transfers provides a further unique advantage. In the past, since the group forming devices, herein called "flight bars", extended laterally from the buckets, a dead plate was provided thereunder. The junction of the dead plate with the adjacent infeed conveyor typically presents a "stumbling point" as the articles move from the infeed conveyor to the dead plate. When final cans in the lane are presented at the noted junction, without pressure from any upstream articles, their feed over junction is not positive. The articles are frequently fed partially or not at all onto the dead plate and can be spread or entirely missed by the flight bars. When the machine had to be cleared of all articles, pusher blocks or such devices were required to push the last articles from the infeed lanes positively onto the dead plate for pickup by flight bars and movement into the buckets. Otherwise there was no mechanism to move the last articles (not subject to pressure from upstream articles) laterally onto the dead plate and toward the buckets. Alternately, these last cans were removed by hand.

In this invention, the intermediate transfer for the lower tier does not extend into the area of group forming for the upper tier. Accordingly, there is no need to accommodate any space beside the bucket conveyor in the upper tier forming area for any flight bars from the lower tier. This means that a live conveyor can be placed directly next to the bucket conveyor for both the upper and lower tiers, without intervention of any dead plate. Accordingly, articles in the infeeds are positively conveyed and urged all the way into the buckets. There is no need for article pusher blocks or such to clear the infeed lanes by pushing the last articles in the lanes into the buckets. The cartoner can thus be run to empty without additional mechanisms for pushing the last articles over a dead plate into the buckets, or without manual intervention.

More particularly, in the previous art with a flight bar device extending from the bucket walls, the lower level could have a live conveyor next to the bucket conveyor. Conveyance of the last cans in the lane onto or over the dead plate was less than positive.

There is yet a further advantage of the invention which arises from the use of intermediate transfers without group or row selecting and forming devices (flight bars) extending from the buckets. In particular, it will be appreciated that such flight bars extend laterally and move in a path beside the bucket-conveyor. Where barrel loaders are used to push groups of articles from the buckets into cartoners, the barrel loader pushers move along beside the buckets and extend through the buckets to push the groups. These pushers must be disposed adjacent the buckets but spaced apart therefrom a distance sufficient to clear the lateral extension of the flight bars. This requires the stroke of each barrel loader pusher to also extend a distance equal to the width or lateral extension of these flight bars, as well as its normal loading stroke. Otherwise, the moving flight bars would hit the pusher ends.

In this invention, the intermediate transfer conveyor terminates upstream of any barrel loader. The barrel loader can thus be placed immediately adjacent the bucket conveyor, there being no such laterally extending flight bars from the buckets. The pusher stroke of the barrel loader can thus be shorter, as compared to prior devices. It does not have to also extend a distance equal to that width of the path of any laterally extending flight bars.

This is an important advantage. It will be immediately appreciated that a smaller barrel loader can be used, resulting in a smaller equipment footprint, higher speeds due to shorter stroke length can be obtained, or a smoother operational loading profile can be utilized. These features may be combined or attained separately for particular installations.

The invention also contemplates a unique partition or slip sheet feeding operation. Preferably, a sheet feeder and its associated magazine is disposed at an upstream end of the bucket conveyor. Partitions are fed onto rails extending along in a machine direction above the elongated path of the forming lower group in the bucket conveyor.

The partitions are fed and transported so that on start up, when the first lower group is formed, a partition conveyed above it is lowered onto that group so the upper group can be formed thereon. A full load of upper and lower groups with intervening partition is thus assured for the first carton to be filled. This invention thus places the sheet feeder and magazine out at the upstream end of the bucket conveyor where it can be easily accessed, preferably near the carton magazine where an operator can tend both carton blank magazine loading and partition magazine loading for the sheet feeder. Access is open and the footprint of the cartoner need not be unduly extended.

This eliminates the requirement to place the sheet feeder and magazine in the area between the lower and upper group forming stations as in the prior art. The upper and lower group forming stations need not be separated, as in the old systems, thereby unduly increasing the cartoner's footprint.

Of course, it will be appreciated that the two aspects of this invention, i.e. the separate and independent transfer guide conveyors and the sheet feeder can be used together when desired, or independently of each other. For example, the independent transfer guide can be used in both single or dual tier cartoners, to the same advantage, even if a sheet feeder described herein is not used over the upstream end of the bucket conveyer.

These and other objectives and advantages will become readily apparent from the following detailed description of the preferred embodiment of the invention and from the drawings in which:

DETAILED DESCRIPTION OF THE INVENTION

Figure 1:
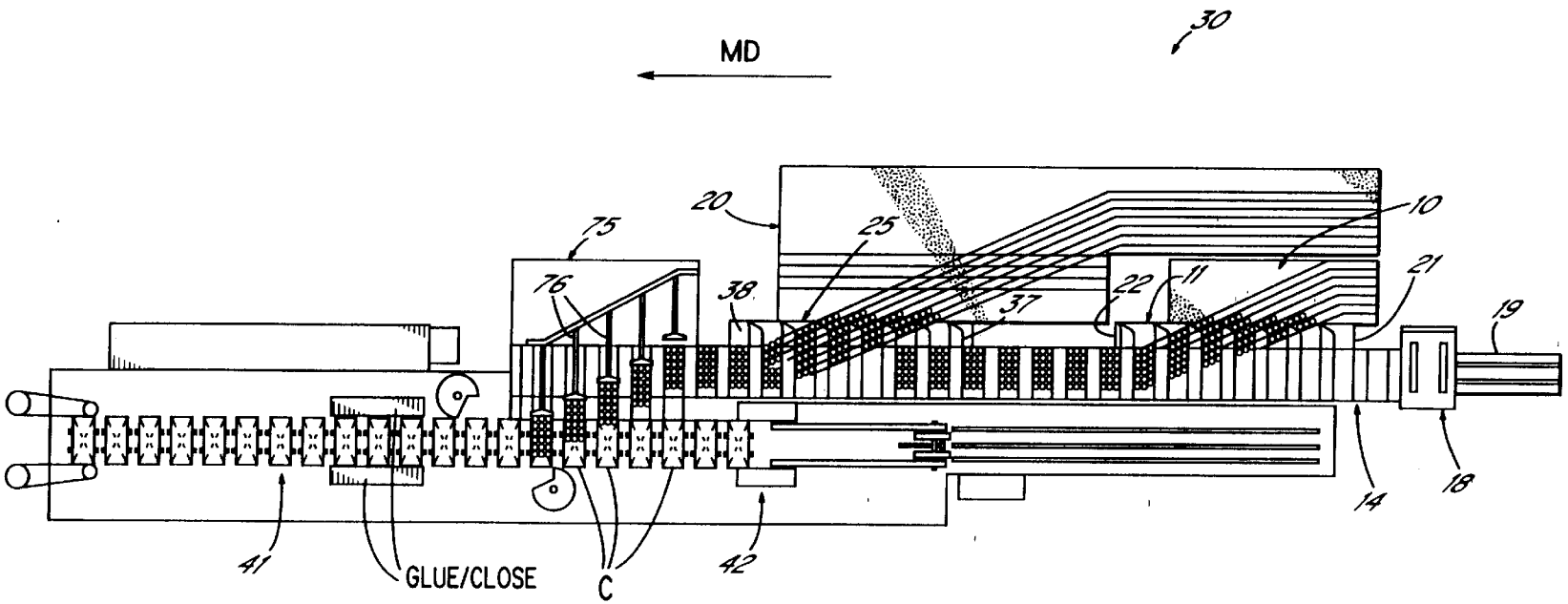
FIG. 1 is a plan view of a cartoner according to the invention.

A dual layer or double tier cartoner 30 is depicted in the FIGS. 1–4 and 6. It will be appreciated that while the cartoner 30 has many uses, it finds particular application in loading cylindrical containers such as cans or glass or plastic bottles into cartons. These are referred to herein as "articles". It will also be appreciated that a dual tier cartoner 30 can also be used to pack single layer tiers into cartons.

The overall function of this cartoner, in a stacked tier format, is to receive articles from lower and upper infeed conveyors 10, 20 to form stacked groups consisting of lower groups LG and upper groups UG of articles on a main bucket conveyor 14. These stacked groups of articles are subsequently inserted by transverse movement into open sleeved cartons "C" which are carried downstream by a carton conveyor 41, and which are subsequently closed and glued. The cartoner utilizes a unique combination of components, including infeed conveyors 10, 20 and intermediate transfer conveyors 11 and 25 which transfer articles to the main bucket conveyor 14.

Figure 2:
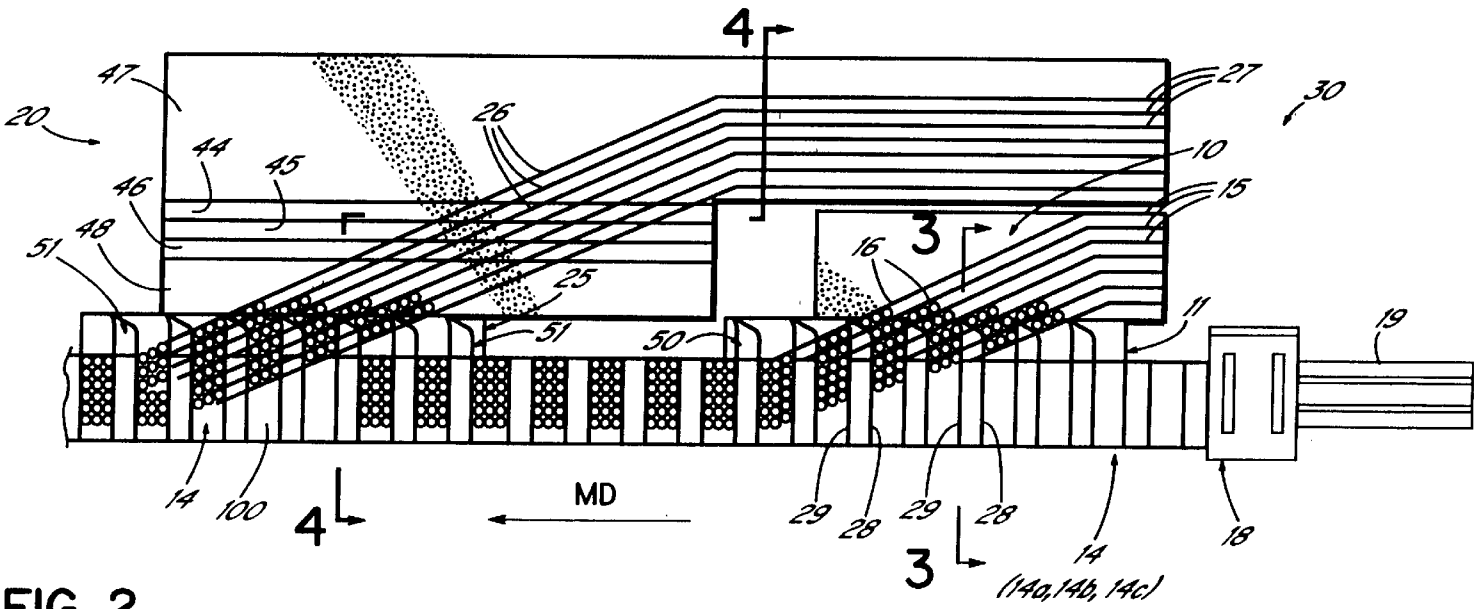
FIG. 2 is an enlarged plan view of the article group forming and partition feeding aspects of the invention of FIG. 1.

The cartoner includes a main, or bucket conveyor 14, having spaced, transverse, leading and trailing bucket walls such as at 28 and 29 in FIG. 2. Although not shown in detail, leading and trailing bucket walls 28, 29 are mounted on separate, respective side-by-side mat, slat or flat top conveyors (14*a*, 14*b*, 14*c*) and the front to back width of a bucket between the walls 28, 29 is adjustable by a phase adjustment of these conveyors as is well known in the art. For each bucket, the trailing wall 29 is carried by outside conveyors 14*a* and 14*c*, while the leading wall 28 is carried by conveyor 14*b*. Adjustment of the phase of conveyor 14*b* with respect to conveyors 14*a*, 14*c* changes the front-to-back bucket dimension of each bucket to accommodate product variations in the size of groups to be loaded into cartons.

The main bucket conveyor 14 is supplied with a first or lower group of articles LG (in FIG. 5) by an intermediate transfer conveyor 10 at a first up-stream location. A partition or divider sheet 100 is fed for insertion between the upper and lower groups or tiers by an "Orbitrak" rotary placer or feeder 18 such as shown in U.S. Pat. No. 4,518,301 and U.S. Pat. No. 5,496,545, incorporated herein by reference and made by applicant. Feeder 18 is supplied with partition sheets 100 from associated magazine 19. Any suitable sheet or partition feeder can be used.

Figure 5:
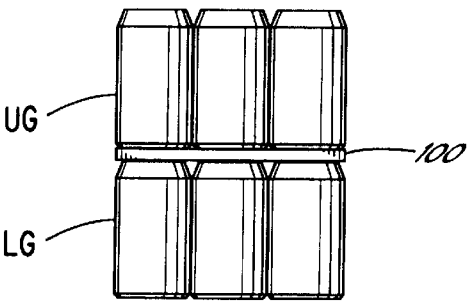
FIG. 5 is a diagrammatic elevational view of upper and lower groups of cans separated by a partition sheet for illustration purposes.
Figure 3:
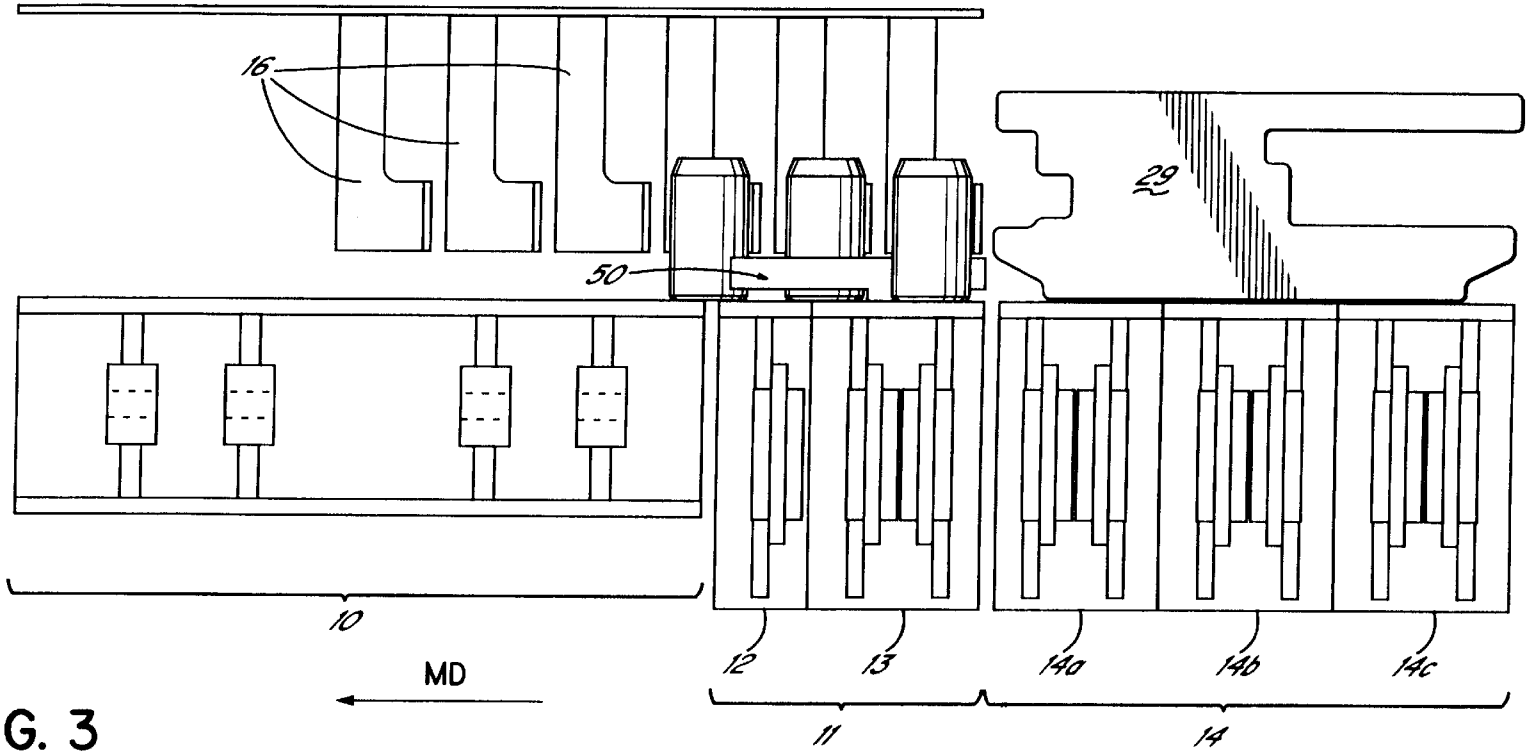
FIG. 3 is a cross-sectional view taken along lines 3—3 of FIG. 2.
Figure 8:
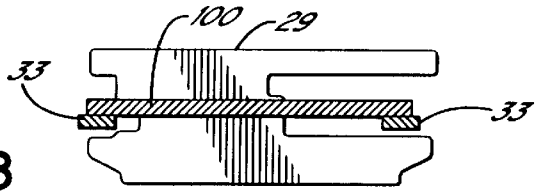
FIG. 8 is a cross-sectional view taken along lines 8—8 of FIG. 6.
Figure 7:
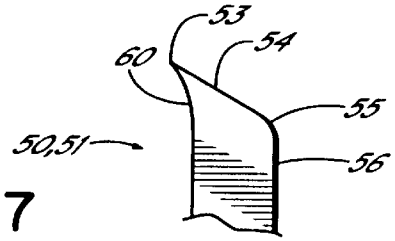
FIG. 7 is a diagrammatic plan view of a transfer guide according to the invention.
Figure 4:
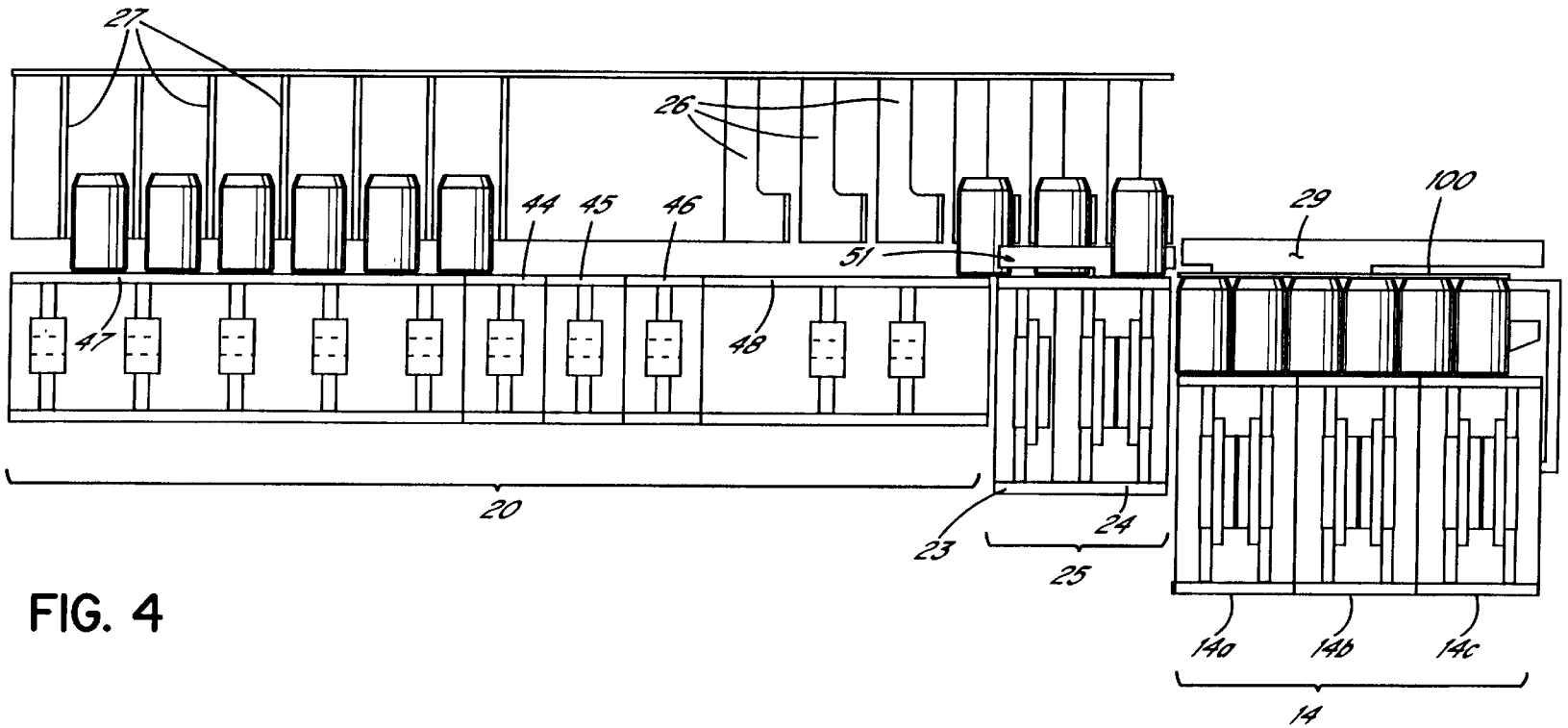
FIG. 4 is a cross-sectional view taken along lines 4—4 of FIG. 2.

In this application, the partition feeder 18 is disposed upstream end and over the main bucket conveyor 14. Partitions 100 are conveyed along guide rails 33 by bucket walls 29, above a first or lower group LG of articles, and above bucket conveyor 14, then laid thereon for receiving a second or upper group of articles UG (in FIG. 5). In the figures and for clarity, the lower group of articles LG is shown with the partition sheet 100 not shown thereover or thereon until viewed at the downstream end of the lower group run near where the partitions 100 are deposited on top of the lower group LG (FIGS. 1, 2 and 6) at a discharge station shown at the lefthand end of FIG. 6. The main bucket conveyor 14 then receives an upper group of articles disposed on the partition 100 from an upper tier infeed conveyor 20 at a location downstream of the placement of the partition 100, thereby forming a stacked article group as illustrated in FIG. 5. A carton conveyor 41, which carries a series of open-ended cartons C, extends parallel and adjacent to the downstream portion of the main bucket conveyor 14. Carton conveyor 41 has an upstream end 42 disposed adjacent the downstream end of the infeed transfer 25 but well downstream of the infeed transfer 11. An elongated carton blank magazine is shown extending to the right upstream of carton conveyor 41 in FIG. 1.

The cartoner also includes a barrel loader 75 adjacent bucket conveyor 14 and including a plurality of spaced pusher members 76 which are moved longitudinally in synchronism with the main bucket conveyor and carton conveyor, and are reciprocated transversely by means of a cam, all as well known in the industry. The pusher members each include a one piece head which engages a stacked article group carried by the bucket conveyor 14 and progressively forces this group transversely off the conveyor 14 and into an adjacent open carton sleeve "C" carried by the carton conveyor 41. After the stacked groups (FIG. 5) have been inserted into the carton sleeves, the sleeves are glued and closed in a conventional manner. Barrel loader 75 can be any form of suitable barrel loader, well known in the industry.

In somewhat greater detail, the infeed conveyor apparatus 10 extends parallel to the upstream end of the main bucket conveyor 14 and is spaced from it. Infeed 10 includes one or more (not shown) conveyors (FIG. 3) moving in a machine direction MD under articles thereon to convey such articles downstream or in a direction with a downstream component.

Upper infeed 20 conveyor includes one or more conveyors. Five conveyors 44–48 are illustrated in the drawings (FIG. 4) for moving articles in a downstream direction or in a direction having a downstream component. The varied conveyors 44–48 may be operated together or separately and as desired to provide a desired article flow parameter. A similar number of conveyors can be used in lower group infeed apparatus 10.

The intermediate transfer conveyor 11 comprised of conveyors 12, 13 is interposed between the infeed conveyor 10 and the bucket conveyor 14 to handle lower groups LG. Intermediate transfer conveyor 11 has an upstream end 21 and a downstream end 22 (FIG. 1). These transfer conveyors 12, 13 comprise an intermediate transfer conveyor 11 which is separate and independent of bucket conveyor 14.

This intermediate transfer conveyor 11 thus terminates at an upstream location with respect to the position of the main bucket conveyor 14, is positioned between the infeed conveyor 10 and the main bucket conveyor 14 and extends for a fraction of the length of that conveyor 14.

A plurality of parallel lane guides 15, 16 (FIG. 2) respectively are disposed above the infeed conveyor 10 and transfer conveyors 12, 13. Parallel spaced guides 15 extend for a distance parallel to the machine direction MD and infeed conveyor 10 and then continuing lane guides 16 angle inwardly toward the main bucket conveyor 14. These guides 15, 16 function to form the articles into a series of parallel lanes of articles, with articles in each lane touching one after the other.

In the past, a series of rotatable star wheels have been disposed proximate the downstream ends of each of the lanes. These star wheels have functioned to slightly space the articles apart, one from the other, and to meter the movement of the articles so that the proper number is selected to be positioned in a row for insertion into each bucket of the bucket conveyor. In this invention, such star wheels are eliminated.

The main bucket conveyor 14 includes no flight bars, as have past cartoners, and includes no article engaging or selecting portion which extends outwardly beyond the lateral edge of the main bucket conveyor 14. Instead, the operation of this portion of the cartoner 30 involves the selection and separation of cans by the intermediate transfer conveyors 11, 25 formed by transfer conveyors 12, 13 and 23, 24 respectively, and transfer guides or linear stars 50, 51 respectively thereon.

The intermediate transfer conveyors 12, 13 thus include a series of transfer guides 50 extending transversely of the linear transfer conveyors 12, 13. They are preferably mounted on conveyor 13 and extend over conveyor 12. Likewise, intermediate transfer 25 includes guides 51 mounted on transfer conveyor 24 extending over transfer conveyor 23.

Thus, in contrast to prior cartoners without star wheels such as in U.S. Pat. No. 3,778,959 or 5,241,806, the transfer guides or linear stars 50, 51 of this invention are separate and distinct from the bucket walls 28, 29 of the main bucket conveyor 14.

Intermediate transfer conveyor 25 has an upstream end 37 and a downstream end 38 (FIG. 1). The selected rows of articles formed by the transfer conveyors 12, 13 and 23, 24 are simply moved transversely into the main buckets of the bucket conveyor 14 by the action of lane guides 16, 26 respectively and the underlying live conveyors. Of course, it will be appreciated that a single conveyor could be used in place of two conveyors 12, 13 or another single conveyor in place of conveyors 23, 24.

It will be appreciated that the upper tier article infeed is similar to the lower tier infeed and has an intermediate transfer conveyor 25 comprised of transfer conveyor 23, 24 extending over a portion of the length of the bucket conveyor 14 and spaced downstream of the lower tier infeed and lower tier transfer conveyor 11. Conveyors 23, 24 comprise the intermediate transfer conveyor 25 separate and independent of bucket conveyor 14 and of intermediate transfer conveyor 11. Lane guides 26 and 27 are associated with the upper tier infeed conveyor 20. Guides 26 preferably extend varying distances across the main bucket conveyor 14, i.e., the upstream lane guide 26 extends approximately 80 percent across the width of the bucket conveyor 14, while the remaining guides 26 extend progressively lesser distances until a last or downstream guide terminates at the edge of the bucket conveyor 14. In all other respects, the upper tier infeed functions in a manner similar to the lower tier infeed.

As noted the front to back width of the main bucket walls 28, 29 can be independently adjusted by a phase adjustment of the conveyors as described. In order to change over to a different number or diameter of cans, i.e., from 3 can rows to 4 can rows, it is only required to adjust the phase of the conveyors (14*a*, 14*b*, 14*c*) of the main bucket conveyor so as to adjust the bucket width between walls 28, 29 and to replace a relatively small number of transfer guides or linear stars 50, 51 on the infeed transfer conveyors 12, 13 and 23, 24. Since these conveyors extend over only a small portion of the length of the main bucket conveyor 14, the changeover parts are reduced in number and cost as opposed to having to change projections from each bucket of the entire conveyor 14.

The guides 50 each include a tapered section which has a pointed end or "forward hook" 53 extending forwardly and angularly from the main portion of the transverse linear star 50. This pointed end is adapted to enter between the last article of a selected series or row and the first article of the next series or row to be selected. The guides 50 are longitudinally spaced a distance equal to the spacing of the pairs of transverse bucket walls defining the forward and leading walls 28, 29 of the buckets of the main bucket conveyor 14. Thus, adjacent guides 50 select a proper number of articles in a series to form a row of articles which fit in a downstream direction into a bucket of the main bucket conveyor 14. As the linear guides 50 move down stream, the forward tapered edge of the guide 50 accelerates the articles in front of the guide to separate them from the articles on the back side 54 of the guide, a distance greater than the combined separation of adjacent leading and trailing bucket walls 28, 29 on the main bucket conveyor 14. Because of the configuration of the guides 50, the articles engage the backside 54 of the guides to control upstream article flow before the preceding row of articles is accelerated. As a result, article speed is controlled without generating any surges or back pressure on the articles behind the guides 50 in the infeed lanes. The series or rows of articles selected by the guides 50 are forced transversely into the buckets by the action of the guides and in combination with the angulated lane guides 16 and the pressure of downstream rows. Of course, transfer guides 51 in the downstream intermediate transfer 25 are constructed and operate in a similar fashion for forming the upper group of articles UG.

In more detail, the pointed end 53 of the transfer guides 50, 51 is determined to smoothly separate rows of cans in the infeed lanes and smoothly control the speed of the incoming cans. For any given configuration of infeed angle, load length and bucket pitch, the forward hook of the guide 50 and the angle of its backside 54 are determined for optimum flow control. This is selected such that a trailing guide 50 must intercept the upstream articles in the infeed lane before the selected, separated row moves or are released around the radius 55 of the backside 54 of the preceding guide 50. If it does not, the article in the infeed lanes can surge forwardly before the insertion of the guide 50. When the articles surge, they take up the space which was to be the gap between the serial rows. Later guide insertion causes changes in infeed flow and surges in articles back upstream.

The "hook forward" approach of guides 50 helps to accelerate the articles after and while the backside 54 controls flow of the remaining upstream articles. The gap between rows (and between buckets) is created by the acceleration of articles longitudinally and forwardly in front of the guide 50 after the guide's backside 54 controls the incoming articles. The upstream control is asserted by the backside 54 before the lead article in the preceding row reaches the radius bend or transition 55 from the angled backside 54 to the perpendicular portion 56 (to flow or machine direction MD) of the backside of the downstream guide 50.

More particularly, when the articles in the selected row just downstream of a first guide 50 engage and pass the radius of the backside 54 of a second downstream guide 50 (i.e. that area where the incline transitions into a surface perpendicular to machine direction) they "surge" or accelerate forwardly. If the upstream article flow is not controlled at this time, the entire infeeding lane can surge forwardly, resulting in a jerky infeed and resulting in undesirable back pressure when the next transfer guide 50 is inserted. Accordingly, it is important to intercept the following articles before the selected row surges or accelerates forwardly to maintain a consistent, constant and smooth infeed flow.

Stated in another way, as long as the supply articles are flowing at a constant velocity and are held by the inclined backside 54 of the guide 50, the infeed is maintained at a constant rate. When the lead article of a selected row gets to the backside radius 55, however, its velocity and that of the articles behind it changes and generally accelerates. If the succeeding articles feeding in are not restrained by the backside of the transfer guide, they too will surge into the selected row before a gap is formed. Subsequent guide insertion to form a gap then can cause a backward surge, and jerky motion in the article flow, producing noise, article damage or inconsistent flow.

In cartoning articles, such as cans or containers of beverages and the like, it is popular to package such cans in different configuration. These may be, for example, a 12 pack flat of four rows of three cans, a 15 pack flat of five rows of three cans, an 18 pack flat of 6 rows of three cans, or a 24 pack flat of six rows of four cans. It is also useful to produce a 24 pack, which constitutes upper and lower groups of cans, each having four rows of three cans, or a 30 pack which constitutes upper and lower groups of cans, each having five rows of three cans. These and other configurations can be cartoned on the cartoner 30 of this invention.

In making a transfer guide 50 then for the cartoner 30, herein, all these noted configurations can be produced by picking off or selecting row counts of either three cans each, or of four cans each, either in a single level operation or in a stacked or multiple tier configuration.

The parameters for determining the length of the pointed ends 53 of the transfer guides or other guide features include the angle of approach of the angled infeed lanes to the machine direction (which is preferably 24") the pitch of the buckets on bucket conveyor 14, (which is preferably 12", where there is preferably one bucket per 12" of conveyor length) and the can diameter (which is preferably about $2^{9/16}$"). Of course, these specific parameters are by way of example only, other values for the parameters might apply. With this information and in this example, a transfer guide 50 is provided for rows of three cans where the length of the pointed portion 53 is sufficient to engage the front end can of the infeed lane before the previously selected three cans are released from the angled backside 54 of the preceding transfer guide. In addition, the angle of the backside 54 of the transfer guide is selected to produce a constant or steady speed for the cans in the infeed lanes prior to their selection, as they are fed forwardly and as the transfer guides move downstream.

As shown in the drawing and in yet more detail within the above machine parameters, a transfer guide 50, 51 is configured for rows of 3 cans each. In such guides, the angle of the forward face 60 is about 77° from the machine direction, the angle of the rear face 54 is about 58° from the perpendicular to the machine direction. The radius 55 where the rear face 54 transitions into the vertical rear face portion 56 is about 45 mm.

If a transfer guide 50, 51 was configured for rows of four cans each, the noted dimensions would be somewhat different when provided for a cartoner 10 of the above machine parameters. In this instance, the forward face 60 of the guide 50 would be about 85° from the machine direction, the angled rear face 54 of the guide 50 would be about 30° from a perpendicular to the machine direction. The rear face 56 of this guide 50, unlike that of the guide 50 for three cans, is angled slightly rearwardly from a perpendicular to the machine direction so it lies about 83° from the machine direction starting with its end nearest the rearward angled face inclining rearwardly with respect to the machine direction. The radius 55 of the curved surface joining the rear angled face 54 and the approximately perpendicular face 56 (83°) is 45 mm. These angles are approximations within about 1.0 degree of tolerance.

Of course, variations in the machine and article parameters, noted above, or in the number of articles per row or in the number of rows for these or other machine parameters may change these angles as will be appreciated by those of ordinary skill in the art.

The upper infeed 20 is substantially identical with the lower infeed 10 except that the ends of the lane guides 26 extend varying distances across the bucket conveyor as noted above. The upstream lane guide 26 preferably extends a substantial portion of the distance across the bucket conveyor 14 while each of the remaining guides 26 extend progressively lesser distances thereacross with the downstream guide 26 terminating at the inner edge of the bucket conveyor 14. The upper tier feed functions in the same manner as the lower tier feed.

After loading, the cartons C are conveyed downstream, where they are conventionally closed and glued as appropriate (FIG. 1).

The cartoner 30 differs substantially from prior known cartoners and provides many advantages over the prior cartoners. In the first place, the cartoner 30 does not utilize flight bars attached to the buckets of conveyor 14, but instead uses intermediate transfer guides 50, 51 mounted on two separate intermediate transfer conveyors 11 and 25. These are not attached to the main bucket conveyor 14 and provide advantages not provided by earlier cartoners in terms of being more flexible, less costly to adjust for different pack configurations, and further as described herein.

In addition, the configuration of the transfer guides 50, 51 with the forward hooks differs from the shape or the ends of flight bars in certain prior cartoners which include, for example, an elongated rectilinear body with an angled front end which slopes from its leading edge to its trailing edge. The configuration of the guides 50, 51 causes the article to be separated in a different manner which provides smoother operation without changes in infeed flow and upstream surges.

Additionally, because it does not employ flight bars extending from the bucket walls 28, 29 of the main bucket conveyor 14, the cartoner 30 permits use of a shorter stroke by the barrel loader 75. This can result in a smoother insertion of cans into the carton sleeves, higher speeds, smaller footprint or space or a combination of these advantages.

Moreover, elimination of the rotatable star wheels from one form of prior cartoner provides a simpler, shorter, less costly cartoner.

Figure 6:
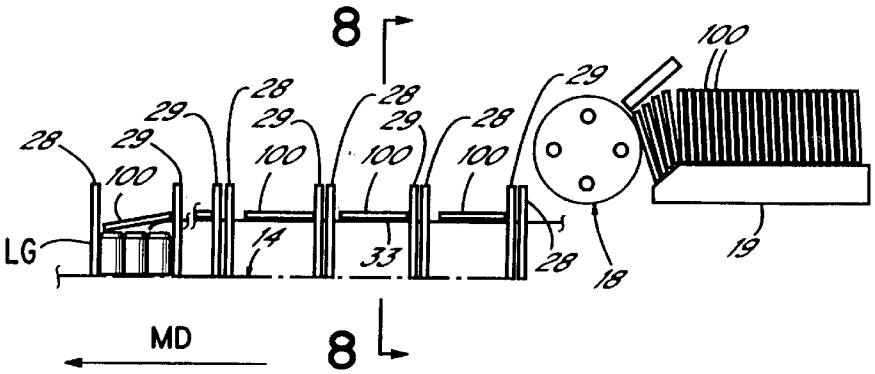
FIG. 6 is a diagrammatic elevational view of components of the partition feeder according to the invention.

Turning now to FIGS. 1, 2 and 6, the sheet feeder 18 is preferable disposed at and over the upstream end of bucket conveyor 14. The feeder 18 receives partitions 100 from magazine 19 and places them flat on rails 33 extending downstream in a machine direction MD. These rails define a path for the partition above the path through which a lower group LG (FIG. 5) of articles is formed and transported within the buckets of conveyor 14. For clarity, in each of FIGS. 1 and 2, the partitions are not shown until they appear just under the forming upper group UG in FIGS. 1 and 2.

The partitions 100 are preferably shifted off rails 33 onto the respective top ends of articles in the lower group LG at a position proximate or between the downstream end 22 of intermediate transfer 11 and the upstream end 37 of intermediate transfer 25.

Preferably, the partitions 100 are pushed along the rails 33 by the upper ends of trailing walls 29 of the buckets therebelow or by any other suitable sheet feeding means. The path of movement of partitions 100 before they are laid or deposited on the lower groups LG, is just above the groups as they are carried by buckets of conveyor 14. This partition path is thus elongated in a machine direction above conveyor 14 from its upstream end.

The feeder 18 and magazine 19, however, are not disposed in a position which is confined or obstructed by either the conveyor 14, infeed 10, infeed 20, the intermediate transfers 11, 25 or the carton conveyor 41. Accordingly, access to both feeder 18 and magazine 19 is facilitated and the infeeds 10, 20 and intermediate transfers 11, 25 can be disposed close together without regard for creating space for the partition feeder 18 or its magazine 19. A single operator can manage filling of both the carton blank magazine and nearby partition magazine 19.

Of course, it will be appreciated that the invention contemplates both single and dual tier cartoning, the separate and independent intermediate transfer guides serving a single layer, or another set thereof serving an additional layer where it is desired to load stacked articles into cartons as described.

Moreover, it will be appreciated that the intermediate transfer described herein and the partition feeder herein can be used in many applications independently of each other.

These and other advantages and modifications will be readily apparent to those of ordinary skill in the art without departing from the scope of the invention and applicant intends to be bound only by the claims appended hereto.

We claim:

1. A cartoner for loading articles into cartons and comprising:

a first plurality of infeed lanes of articles, said articles engaging each other within said lanes;

a bucket conveyor for receiving rows of articles in a group and transporting said group of articles for loading into a carton;

a first transfer conveyor disposed at one elevation and between said infeed lanes and said bucket conveyor, said transfer conveyor having article selecting transfer guides mounted thereon, said guides intersecting articles proximate respective downstream ends of said infeed lanes, selecting respective rows of articles from said infeed lanes, separating said selected rows from other articles in said lanes and transferring said respective rows toward buckets of said bucket conveyor to form a first group of articles; and said transfer conveyor being operably coordinated with said bucket conveyor but being independent and separate therefrom.

2. A cartoner as in claim 1 including:

a second plurality of infeed lanes of articles at a higher elevation with respect to said bucket conveyor than said first plurality of infeed lanes of articles, said articles therein engaging each other within said infeed lanes of said second plurality;

a second transfer conveyor at a higher elevation than the first transfer conveyor with respect to said bucket conveyor and disposed between said second plurality of infeed lanes and said bucket conveyor, said second transfer conveyor having second transfer guides mounted thereon, said second transfer guides on said second transfer conveyor intersecting articles proximate respective downstream ends of said second plurality of infeed lanes, selecting rows of articles from said second plurality of infeed lanes, separating selected rows from other articles in said second plurality of lanes, and transferring said selected rows from said second plurality of infeed lanes toward buckets of said bucket conveyor to form a second upper group of articles over said first group;

said second transfer conveyor being operably coordinated with said bucket conveyor but being independent and separate therefrom.

3. A cartoner as in claim 2 further including a sheet feeder disposed over an upstream end of said bucket conveyor for feeding partitions, and partition transporting rails extending over said bucket conveyor adjacent said first transfer conveyor, said partition being guided by said rails to a partition discharge station wherein said partition is then deposited on said first group of articles.

4. A cartoner as in claim 2 wherein said second transfer conveyor comprises two conveyor runs and said transfer guides are mounted on one of said conveyor runs adjacent said bucket conveyor and extend over a second of said conveyor runs adjacent said infeed lanes.

5. A cartoner as in claim 2 further including an infeed conveyor beneath said second plurality of lanes for moving articles therein in a downstream direction, and said second transfer conveyor comprising at least first and second conveyor runs with said transfer guides being mounted on at least one of said first and second conveyor runs.

6. A cartoner as in claim 1 wherein said transfer conveyor comprises two conveyor runs and said transfer guides are mounted on one of said conveyor runs adjacent said bucket conveyor and extend over a second of said conveyor runs adjacent said infeed lanes.

7. A cartoner as in claim 1 further including an infeed conveyor beneath said lanes for moving articles therein in a downstream direction, and said transfer conveyor comprising at least first and second conveyor runs with said transfer guides being mounted on at least one of said first and second conveyor runs.

8. In a cartoner for loading articles into a carton wherein said cartoner includes a bucket conveyor having buckets thereof for transporting groups of articles for loading into cartons, article handling apparatus comprising:

a plurality of article feed lanes;

an intermediate transfer conveyor disposed between said bucket conveyor and said plurality of article feed lanes, each lane for feeding articles in a path, toward said bucket conveyor and wherein articles are engaged together serially;

a plurality of transfer guides on said intermediate article transfer conveyor, said guides intersecting articles in said lanes, selecting a count of articles from said lanes, separating said selected count of articles from said lane, and transferring said articles toward said bucket conveyor;

said intermediate article transfer conveyor being separate and independent from said bucket conveyor and said guides being indexed operably with said buckets.

9. A cartoner for loading articles into cartons carried on a cartoner conveyor and comprising:

a first plurality of infeed lanes of articles, said articles engaging each other within said lanes;

a bucket conveyor having buckets for receiving rows of articles in a group;

a first transfer conveyor disposed at one elevation and between said infeed lanes and said bucket conveyor, said transfer conveyor having article selecting transfer guides mounted thereon, said guides intersecting articles proximate respective downstream ends of said infeed lanes, selecting respective rows of articles from said infeed lanes, separating said selected rows from other articles in said lanes and transferring said respective rows toward buckets of said bucket conveyor to form a first group of articles in said buckets;

said first transfer conveyor being operably coordinated with said bucket conveyor but being independent and separate therefrom;

a carton conveyor; and said bucket conveyor extending operably alongside a portion of said carton conveyor for loading groups of articles from said bucket conveyor into cartons on said carton conveyor.

10. In a cartoner for loading articles into a carton wherein said cartoner includes a bucket conveyor having buckets thereof for transporting groups of articles for loading into cartons carried on a carton conveyor, article handling apparatus comprising:

a plurality of article feed lanes;

an intermediate transfer conveyor disposed between said bucket conveyor and said plurality of article feed lanes, each lane for feeding articles in a path, toward said bucket conveyor and wherein articles are engaged together serially;

a plurality of transfer guides on said intermediate article transfer conveyor, said guides intersecting articles in said lanes, selecting a count of articles from said lanes, separating said selected count of articles from said lane, and transferring said articles toward said bucket conveyor;

said intermediate article transfer conveyor being separate and independent from said bucket conveyor and said guides being indexed operably with said buckets; and said bucket conveyor operably disposed alongside said carton conveyor for transfer of articles on said bucket conveyor into cartons carried on said carton conveyor.

11. A cartoner for loading articles into cartons and comprising:

a bucket conveyor having buckets for receiving articles and transporting articles in groups to a position for insertion as a group from said bucket conveyor into cartons;

a first plurality of article infeed lanes, having articles engaging each other in said lanes;

a first transfer conveyor extending in a direction proximate said bucket conveyor and separate and independent thereof; and said transfer conveyor having a plurality of article selecting transfer guides thereon, said guides intersecting articles proximate respective downstream ends of said infeed lanes, separating said selected rows from other articles in said lanes, and transferring said respective rows towards buckets of said bucket conveyor to form a first group of articles in said buckets, said first transfer conveyor being coordinated with said bucket conveyor but remaining separate and independent thereof.

12. A cartoner as in claim 11 wherein said first transfer conveyor is shorter than said bucket conveyor.

13. A cartoner as in claim 12 wherein the number of said transfer guides is less than the number of said buckets.

* * * * *